US006522074B2

(12) United States Patent
Kim

(10) Patent No.: US 6,522,074 B2
(45) **Date of Patent: *Feb. 18, 2003**

(54) PLASMA DISPLAY DEVICE HAVING A THIN DIELECTRIC SUBSTRATE

(75) Inventor: Dai-il Kim, Suwon (KR)

(73) Assignee: Samsung SDI Co., Ltd., Kyungki-Do (KR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/229,625

(22) Filed: Jan. 13, 1999

(65) Prior Publication Data

US 2002/0153839 A1 Oct. 24, 2002

(30) Foreign Application Priority Data

Jan. 14, 1998 (KR) ..... 98-848

(51) Int. Cl.[7] ..... H01J 17/49

(52) U.S. Cl. ..... 313/586; 313/584; 313/587; 313/491

(58) Field of Search ..... 313/491, 582–587, 313/495, 496, 497, 234, 607, 594; 315/169.1, 169.3, 169.4; 345/60, 37, 67, 68

(56) References Cited

U.S. PATENT DOCUMENTS

| | | | | | |
|---|---|---|---|---|---|
| 3,509,408 | A | * | 4/1970 | Holz | 313/586 |
| 3,935,494 | A | * | 1/1976 | Dick et al. | 313/587 |
| 4,297,613 | A | * | 10/1981 | Aboelfotoh | 313/584 |
| 4,803,402 | A | * | 2/1989 | Raber et al. | 313/587 |
| 5,541,479 | A | * | 7/1996 | Nagakubo | 313/587 |
| 5,701,056 | A | * | 12/1997 | Shinohara | 313/584 |
| 5,957,743 | A | * | 9/1999 | Konishi et al. | 313/587 |
| 6,160,345 | A | * | 12/2000 | Tanaka | 313/587 |

* cited by examiner

*Primary Examiner*—Michael H. Day
*Assistant Examiner*—Mariceli Santiago
(74) *Attorney, Agent, or Firm*—Lowe Hauptman Gilman & Berner, LLP

(57) ABSTRACT

A plasma display device including a rear substrate, a first electrode formed on an upper surface of the rear substrate in a striped pattern, a dielectric layer formed on the upper surface of the rear surface such that the first electrode is embedded therein, a plurality of partitions defining a discharge space formed on an upper surface of the dielectric layer, a front substrate installed above the partitions and formed of a transparent dielectric thin plate, and second and third electrodes formed on an upper surface of the front substrate to cross with the first electrode.

6 Claims, 2 Drawing Sheets

PLASMA DISPLAY DEVICE HAVING A THIN DIELECTRIC SUBSTRATE

BACKGROUND OF THE INVENTION

1. Field of the Invention

The present invention relates to a plasma display device, and more particularly, to a plasma display device having improved structures of a front substrate and a dielectric layer.

2. Description of the Related Art

A plasma display device forms an image by exciting fluorescent material using ultraviolet rays generated by discharging the gas filled between two substrates disposed to face each other where a plurality of electrodes are formed.

FIG. 1 is a perspective view of an example of a conventional plasma display device of a surface discharge type. Referring to the drawing, a dielectric layer 13 is formed on an upper surface of a rear substrate 11 and an address electrode 12 in a striped pattern is embedded in the dielectric layer 13. A partition 14 for defining a discharge space is formed on an upper surface of the dielectric layer 13. A front substrate 15 is installed above the partition 14. A common electrode 16 and a scan electrode 17, both in striped patterns, are formed under a lower surface of the front substrate 15 to cross with the address electrode 12. The common electrode 16 and the scan electrode 17 are provided with bus electrodes 16*a* and 17*a* for reducing line resistance. A dielectric layer 18 is formed under the lower surface of the front substrate 15 such that the common electrode 16 and the scan electrode 17 can be embedded. A protective layer 19 formed of MgO, for example, is formed on a lower surface of the dielectric layer 18. A flourescent layer 20 is coated in a discharge space between the partitions 14.

As described above, in the conventional plasma display device having the above structure, when a predetermined voltage is applied to the above electrodes, wall charges are filled inside the discharge space by a preliminary discharge between the address electrode 12 and the common electrode 16. In this state, a maintenance discharge occurs between the common electrode 16 and the scan electrode 17 so that light is emitted.

In manufacturing the dielectric layer 18 of the above plasma display device, a paste formed of material for the dielectric layer 18 is printed on the lower surface of the front substrate 15 where the electrodes 16 and 17 are formed and then the printed paste is dried and cured two or three times. As a result, the steps for forming the dielectric layer increase and additional equipments should be provided therefor. Also, bubbles or foreign material can be generated or included in the dielectric layer during the step of coating the dielectric layer 18 and it is not easy to coat the dielectric layer 18 to a uniform thickness. The uneven dielectric layer 18 can cause difference in voltage applied to the dielectric layer to lower operational reliability of the display. Further, the dielectric layer 18 lowers light transmittance with respect to the front substrate 15 and accordingly resolution of an image is lowered.

SUMMARY OF THE INVENTION

To solve the above problems, it is an objective of the present invention to provide a plasma display device which can reduce the man-hour needed for manufacturing the dielectric layer and improve brightness of an image.

Accordingly, to achieve the above objective, there is provided a plasma display device which comprises: a pair of substrates installed to face each other, at least one of the substrates being formed of a dielectric thin plate; a plurality of partitions for defining a discharge space formed between the substrates; and an electrode formed on an outer surface of the substrate which is formed of the dielectric thin plate.

According to another aspect of the present invention, there is provided a plasma display device which comprises: a rear substrate: a first electrode formed on an upper surface of the rear substrate in a striped pattern; a dielectric layer formed on the upper surface of the rear surface such that the first electrode is embedded therein; a plurality of partitions defining a discharge space formed on an upper surface of the dielectric layer; a front substrate installed above the partitions and formed of a transparent dielectric thin plate; and second and third electrodes formed on an upper surface of the front substrate to cross with the first electrode.

BRIEF DESCRIPTION OF THE DRAWINGS

The above objective and advantages of the present invention will become more apparent by describing in detail a preferred embodiment thereof with reference to the attached drawings in which.

DETAILED DESCRIPTION OF THE INVENTION

Figure 1:
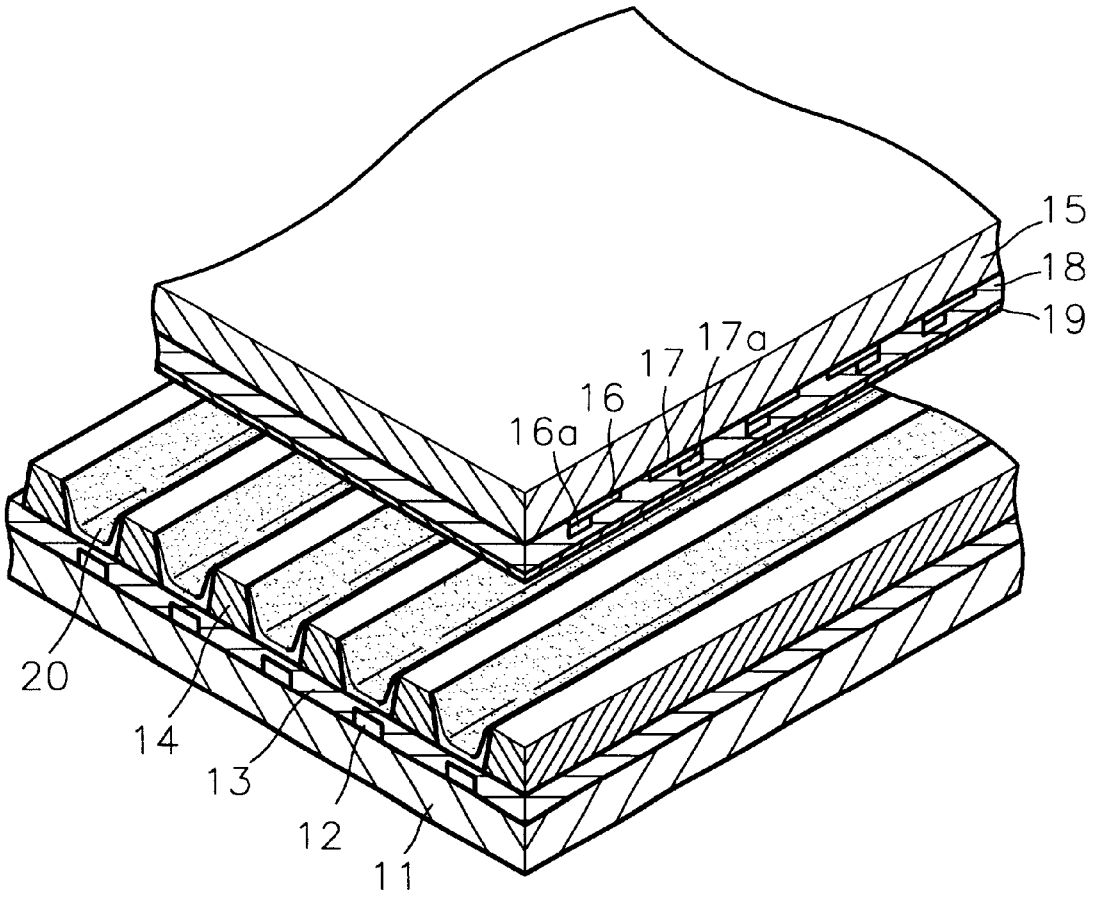
FIG. 1 (PRIOR ART)
FIG. 1 is an exploded perspective view illustrating a conventional plasma display device.
Figure 2:
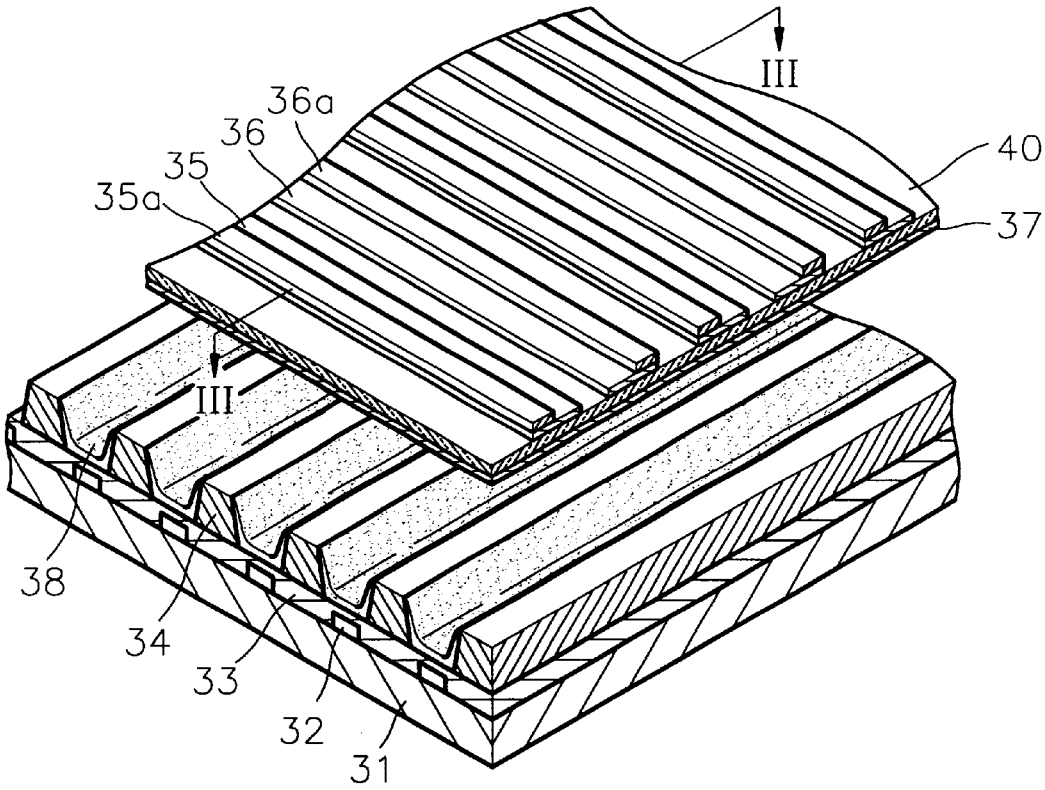
FIG. 2 is an exploded perspective view illustrating a plasma display device according to the present invention.
Figure 3:
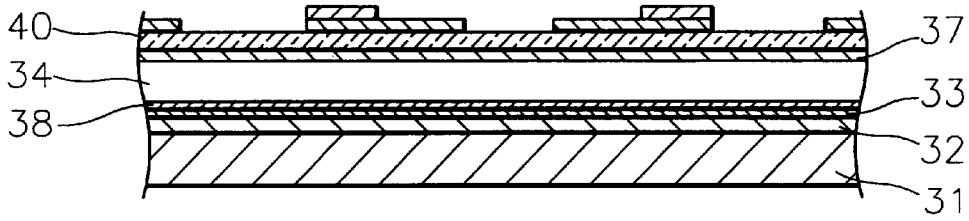
FIG. 3 is a sectional view of the plasma display device, taken along line III—III of FIG. 2.

A plasma display device according to the present invention adopts a thin glass substrate which functions as the dielectric layer, which is shown in FIGS. 2 and 3. Referring to the drawings, an address electrode 32 in a striped pattern is formed on an upper surface of a rear substrate 31. A dielectric layer 33 is coated on the rear substrate 31 to embed the address electrode 32. A partition 34 for defining a discharge space is formed on an upper surface of the dielectric layer 33 to be parallel to the address electrode 32.

According to a characteristic feature of the present invention, a thin front substrate 40 formed glass which is dielectric material is installed above the partition 34. The front substrate 40 simultaneously performs a function of a dielectric layer.

First and second electrodes 35 and 36 in transparent striped patterns are formed on an outer surface, i.e, an upper surface of the front substrate 40 to cross with the address electrode 32. Bus electrodes 35*a* and 36*a* for reducing the resistance of electrode are formed on the first and second electrodes 35 and 36, respectively. A transparent electrode protection layer (not shown) can further be formed on the front substrate 40 to embed the first and second electrodes 35 and 36.

Also, a protective layer 37 formed of MgO can be formed on a lower surface of the front substrate 40 and a fluorescent layer 38 is formed in a discharge space sectioned by the partition 34.

According to the another preferred embodiment of the present invention, which is not shown, the rear substrate 31 can be manufactured into a thin plate formed of dielectric material. In this case, the address electrode is formed on the lower surface of the rear substrate 31 and the partition is formed on the upper surface of the rear substrate 31.

The operation of the plasma display device having the above structure is divided into an address driving and a sustain driving. In the address driving, wall charges generated due to the discharge are accumulated as voltage is applied to the address electrode 32 and the first electrode 35. In the sustain driving, a glow discharge is generated by applying the same voltage to the first electrode 35 and the selected second electrode 36. The fluorescent layer 18 is excited by ultraviolet rays generated during the glow discharge, thus forming an image.

As described above, in the plasma display device according to the present invention, since a glass thin plate functioning as a dielectric layer is adopted, the structure of display device is simplified and light transmittance thereof becomes high, thus improving brightness. Also, the use of glass thin plate can facilitate manufacturing of the display device and remove the defects due to bubbles and foreign material occurring when the dielectric layer is manufactured according to the conventional coating method. Further, since the glass thin plate can be manufactured to a uniform thickness, operational reliability of the display device can be increased.

It is noted that the present invention is not limited to the preferred embodiment described above, and it is apparent that variations and modifications by those skilled in the art can be effected within the spirit and scope of the present invention defined in the appended claims.

What is claimed is:

1. A plasma display device, comprising:

a rear substrate;

a first electrode formed on an upper surface of said rear substrate in a striped pattern;

a dielectric layer formed on the upper surface of said rear substrate such that said first electrode is embedded between said rear substrate and said dielectric layer;

a plurality of partitions formed on an upper surface of said dielectric layer;

a front substrate installed above said partitions and formed of a transparent dielectric thin plate; and second and third electrodes formed on an upper surface of said front substrate to cross with said first electrode, wherein upper surfaces of said second and third electrodes are exposed without being directly covered with insulating material, and a lower surface of the rear substrate is exposed without being covered by a conductive material.

2. The plasma display device as claimed in claim 1, further comprising a protective layer of MgO formed on a lower surface of said front substrate.

3. The plasma display device as claimed in claim 1, wherein said front substrate is formed of transparent glass.

4. A plasma display device, comprising:

a rear substrate;

a first electrode formed on an upper surface of said rear substrate in a striped pattern;

a dielectric layer formed on the upper surface of said rear substrate such that said first electrode is embedded between said rear substrate and said dielectric layer;

a plurality of partitions formed on an upper surface of said dielectric layer;

a front substrate installed above said partitions and formed of a transparent dielectric thin plate; and second and third electrodes formed on an upper surface of said front substrate to cross with said first electrode;

wherein upper surfaces of said second and third electrodes are exposed without being directly covered with insulating material; and an addressing voltage and a sustaining voltage are applied to the first electrode during an addressing period and a sustaining period, respectively.

5. The plasma display device as claimed in claim 4, further comprising a protective layer of MgO formed on a lower surface of said front substrate.

6. The plasma display device as claimed in claim 4, wherein said front substrate is formed of transparent glass.

* * * * *